US006167217A

United States Patent [19]

Kelsch et al.

[11] Patent Number: 6,167,217

[45] Date of Patent: Dec. 26, 2000

[54] FLEXIBLE XEROGRAPHIC PROCESS CONTROLS PATCH SCHEDULER

[75] Inventors: Dawn Marie Kelsch, Erie, Colo.; Ragni Mehta, Webster, N.Y.; Keith A. May, Palmyra, N.Y.; Douglas Brian Chlebove, Honeoye Falls, N.Y.

[73] Assignee: Xerox Corporation, Rochester, N.Y.

[21] Appl. No.: 09/455,392

[22] Filed: Dec. 6, 1999

[51] Int. Cl.[7] ..... G03G 15/00; G03G 21/00

[52] U.S. Cl. ..... 399/72; 399/49

[58] Field of Search ..... 399/49, 51, 72

[56] References Cited

U.S. PATENT DOCUMENTS

| | | | |
|---|---|---|---|
| 5,543,896 | 8/1996 | Mestha | 399/49 |
| 5,623,714 | 4/1997 | Thompson et al. | 399/51 |
| 5,652,946 | 7/1997 | Scheuer et al. | 399/49 |
| 5,987,271 | 11/1999 | Regelsberger et al. | 399/49 X |

*Primary Examiner*—Fred L Braun

*Attorney, Agent, or Firm*—Perman & Green, LLP

[57] ABSTRACT

An image processing control system which employs a patch schedule processor that schedules the writing of patches to the photoreceptor belt on demand in response to adjustments generated by prior cycles of image process control.

8 Claims, 3 Drawing Sheets

FLEXIBLE XEROGRAPHIC PROCESS CONTROLS PATCH SCHEDULER

BACKGROUND OF THE INVENTION

In conventional xerographic systems, a performance maintenance system continuously checks the image generating process to ensure that the image quality is kept at predetermined standards. To accomplish this purpose, image patches are inserted on the photoreceptor belt in zones between the document zones generated by the user. The image patches are monitored and analyzed to adjust the process parameters. The monitoring, analyzing and adjusting process is performed whenever an image patch is present on the belt. With the newer multicolored systems there has been an increased burden on the performance maintenance system to schedule patches frequently in order to ensure acceptable image quality.

The scheduling process is computer driven and, according to the systems of the prior art, uses a fixed schedule of patch generation. This results in the maintenance process occurring at times where there is no need. Since patch generation requires the use of toner, an excessive amount of toner may be used in the image quality maintenance process. It is a purpose of this invention to provide an image quality maintenance system which schedules the generation of patches in an as needed basis to reduce the number of overall patches required.

SUMMARY OF THE INVENTION

A microprocessor platform is operated by a series of algorithms which effectively represent functional modules of the microprocessor platform. The platform is constructed to generate image quality maintenance patches. The modules include a process control scheduler which determines, in a predetermined sequence, the analysis of a patch according to algorithms designed for monitoring basic xerographic process parameters and generating actuator instructions to adjust a particular parameter. Xerographic process operation is monitored to determine the degree of adjustment required during each process sequence. Data representing the current state of the xerographic process is analyzed and the schedule of patches altered accordingly.

DESCRIPTION OF THE DRAWING

The invention is described in more detail below with reference to the attached drawing in which.

DESCRIPTION OF THE PREFERRED EMBODIMENT

Figure 1:
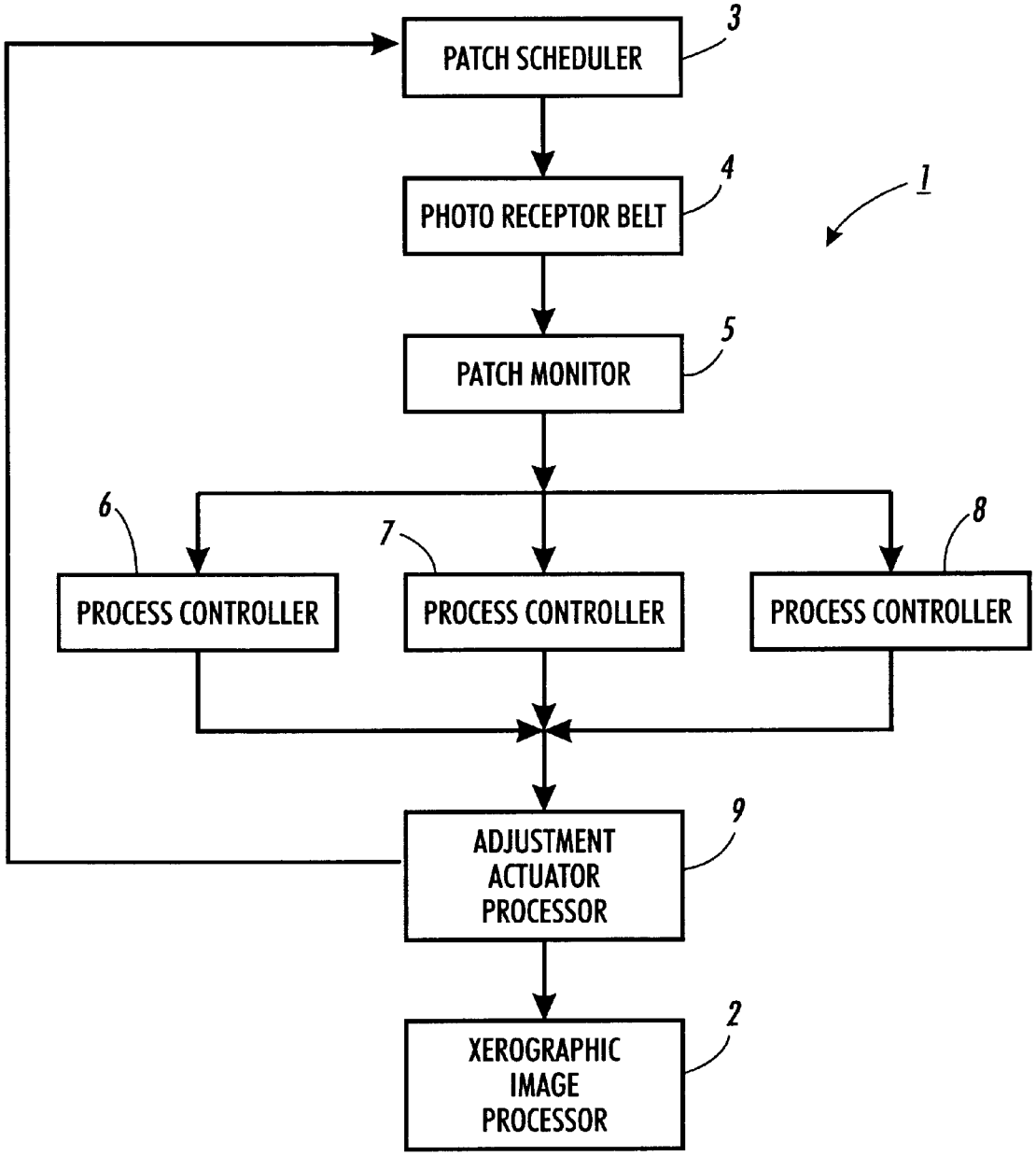
FIG. 1 is a block diagram of the system of this invention.

An image quality process control system 1 for xerographic image system 2 is shown in FIG. 1 and is constructed of a microprocessor controller operated by a series of algorithms which effectively represent functional modules of the microprocessor. Each of the modules includes an algorithm to affect the particular function of the module. An image control patch scheduler 3 generates an image test patch on the photoreceptor belt 4 to provide a medium for analyzing and monitoring the quality of the xerographic process. This medium could also be a drum or other suitable photoreceptive mechanism.

These patches are applied on the photoreceptor belt at interdocument zones, which are between the document images generated by the user, or in any other location which is not being utilized for user's document images. In the demanding environment of today's image output terminals, the patches are generated by the scheduler on a fixed schedule which may fill the available zones. Each time a patch is generated toner is used. In order to correlate the generation of patches with actual need and avoid excessive patches, the scheduler 3 is responsive to the adjustments generated by the actuator processor 9.

The patch is monitored by patch monitor 5 which senses and collects xerographic process performance data and passes it to the process controllers 6, 7, and 8. Each of these processors is driven by algorithms designed to analyze a particular xerographic process control element, such as charge voltage, ROS exposure, development and others as the application requires. In addition these processes generate an adjustment to correct any of the elements which are not within the predetermined quality standard ranges. The xerographic system response to the adjustment is monitored and compared with predetermined limits in the xerographic process controllers 6–8. The xerographic process controllers are constructed to generate an image patch when the current operating conditions exceeds the predetermined limits. In this manner a patch is generated relative to need and the use of wasteful fixed schedules is minimized.

Figure 2:
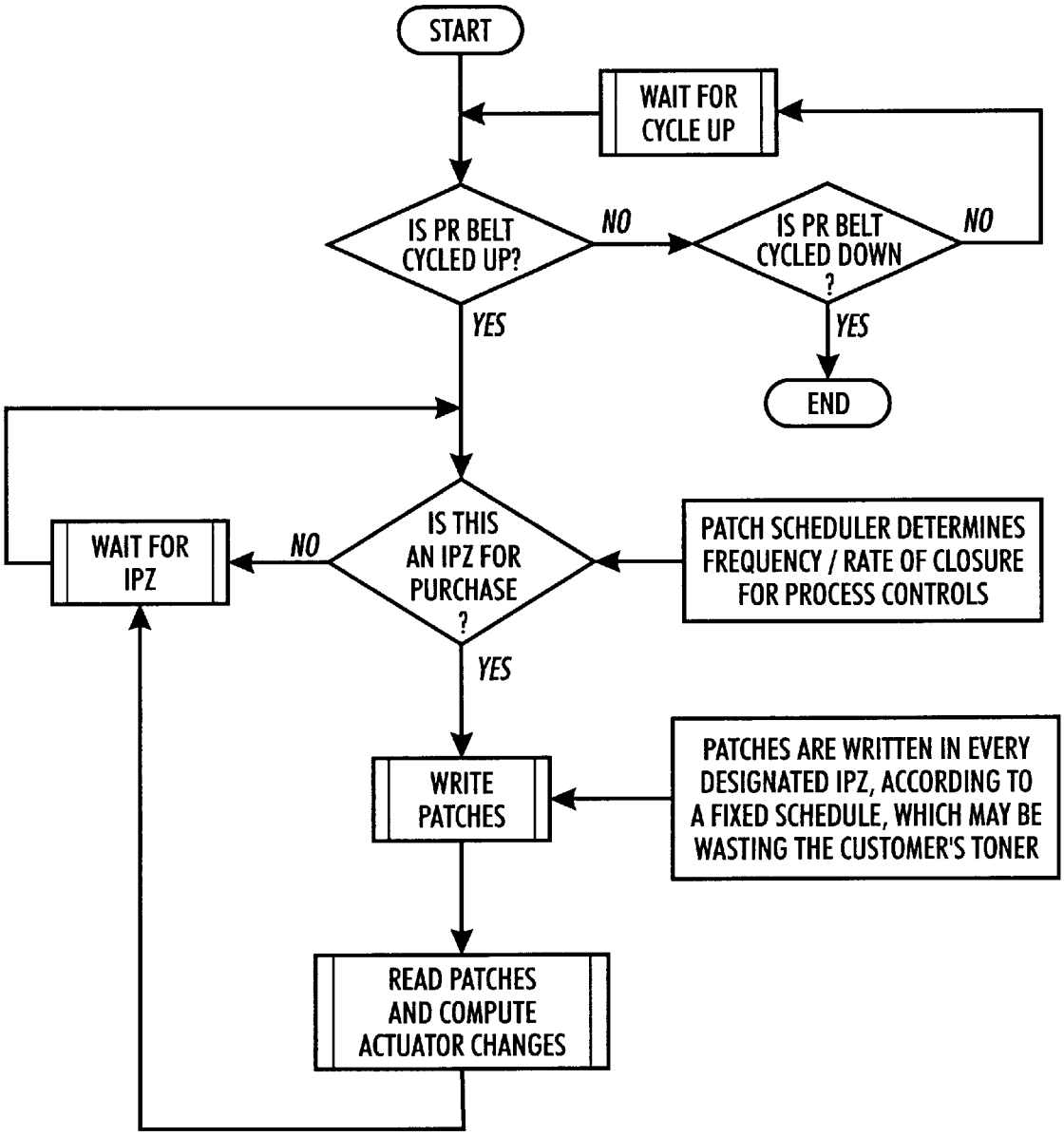
FIG. 2 (Prior Art)
FIG. 2 is a diagram illustrating the operation of a system representative of the prior art.
Figure 3:
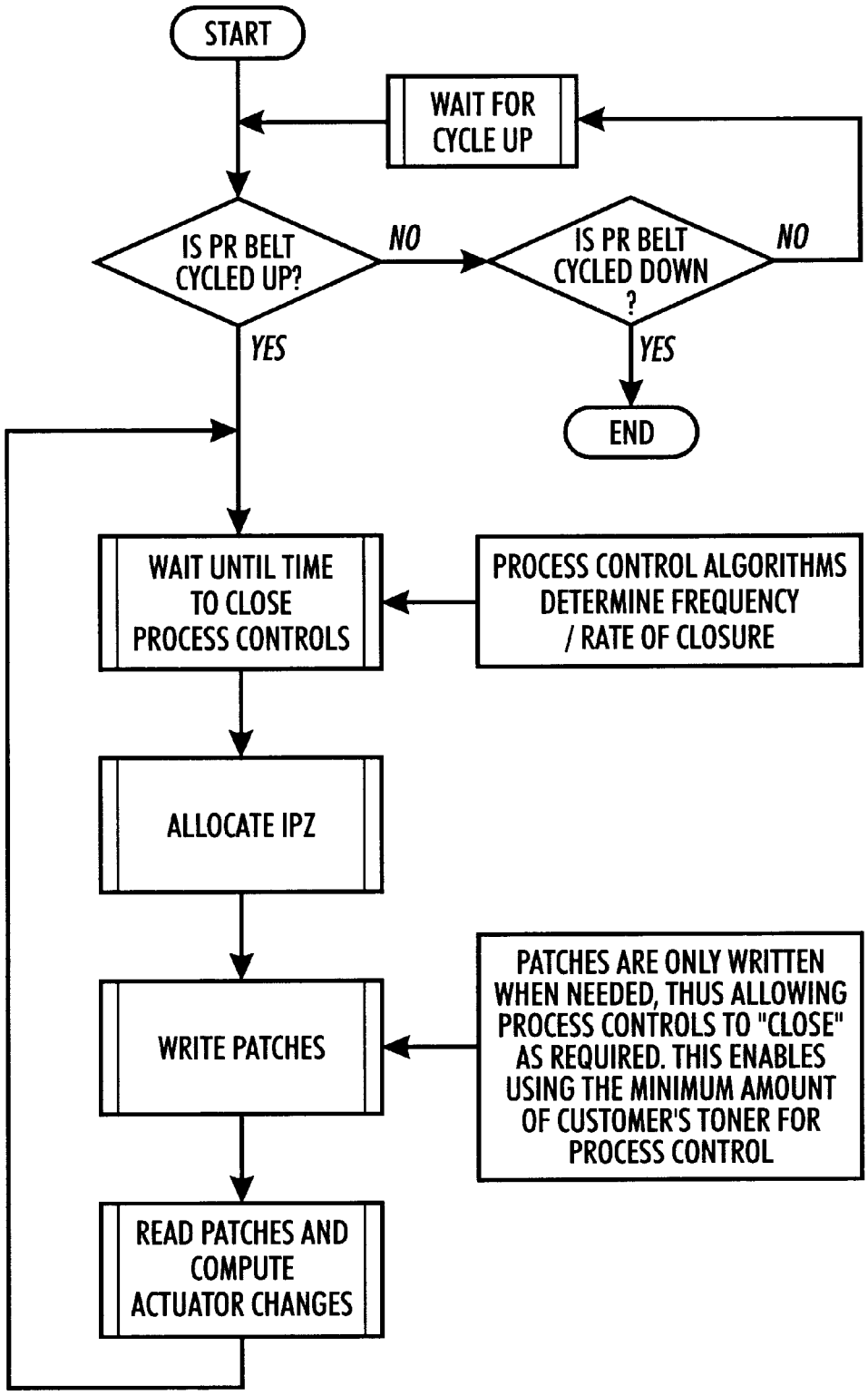
FIG. 3 is a diagram illustration the operation of the system of this invention.

The operation of a xerographic process control of the prior art is illustrated in FIG. 2. In this system patches are generated for each interdocument zone according to fixed schedule without regard to what is actually needed. This takes time and toner thereby lowering performance and user satisfaction. The operation of the xerographic process control system of the subject invention is shown in FIG. 3. In this system, the xerographic process controllers determine the frequency of writing (generating) patches in response to the current state of the xerographic system as measured by the patch monitor 5. Initially a patch will be written according to a fixed schedule, but thereafter the scheduler will generate a patch upon demand as determined by the xerographic process controllers 6, 7, and 8. In a stable xerographic system, the frequency of writing and monitoring patches will be at a fixed low rate. However, the rate of writing/monitoring patches and adjusting actuators will increase as the xerographic system stability decreases.

We claim:

1. In a xerographic imaging system including a photoreceptor medium on which are generated images in response to user documents, an image quality process controller comprising:

a patch scheduler constructed to generate image test patches on the photoreceptor medium during intervals between document images generated by the user;

a patch monitor for sensing process control related data from the image test patches;

at least one process controller having algorithms designed to analyze the process control data and to generate an adjustment for improving image quality; and wherein the process adjustment is further processed to schedule the generation of a patch when said image quality adjustment indicates it.

2. In a xerographic imaging system including a photoreceptor medium on which are generated images in response to user documents, an image quality process controller, as described in claim 1, wherein said at least one process controller compares the process control adjustment with a predetermined standard and instructs the patch scheduler to schedule the generation of a patch in response thereto.

3. A xerographic process control system comprising:

a monitor for sensing process control data from a image test patch written to a photoreceptor medium;

a process controller constructed to receive the process control data from the monitor, analyze said data and generate a process control adjustment; and a patch scheduler constructed to schedule the writing of a image test patch to the photoreceptor medium in response to the process control adjustment.

4. A xerographic process control system, as described in claim 3, wherein the process controller further compares the process control adjustment to a predetermined standard to determine if a image test patch should be scheduled.

5. In a xerographic imaging system including a photoreceptor medium on which are generated images in response to user documents, an image quality control process comprising the steps of:

generating an image test patch on the photoreceptor medium;

sensing process control data from said image test patch;

analyzing the process control data to determine a process control adjustment to improve image quality;

processing said process control adjustment to determine if a further image test patch should be generated; and scheduling the generation of an image test patch if indicated by the process control adjustment.

6. In a xerographic imaging system including a photoreceptor medium on which are generated images in response to user documents, an image quality control process as described in claim 5 wherein the step of processing said process control adjustment to determine if a further image test patch should be generated further comprises comparing said process control adjustment to a predetermined standard.

7. An image quality control process comprising the steps of:

sensing process control data from an image test patch written to a photoreceptor medium;

analyzing the process control data to determine a process control adjustment to improve image quality; and scheduling the writing of an image test patch to the photoreceptor medium in response to the process control adjustment.

8. An image quality control process, as described in claim 7, wherein the step of analyzing the process control data to determine a process control adjustment to improve image quality further includes comparing the process control adjustment to a predetermined standard to determine if a image test patch should be scheduled.

* * * * *